US006131361A

United States Patent [19]

Murphy

[11] Patent Number: 6,131,361

[45] Date of Patent: Oct. 17, 2000

[54] DISPLACEABLE SUPPORT BRACKET FOR DRYWALL PANEL INSTALLATION

[76] Inventor: James T. Murphy, R.D.#4, P.O. Box 4182, Pottsville, Pa. 17901

[21] Appl. No.: 09/261,072

[22] Filed: Mar. 2, 1999

Related U.S. Application Data

[60] Provisional application No. 60/076,767, Mar. 4, 1998.

[51] Int. Cl.[7] ..... E04F 21/18

[52] U.S. Cl. ..... 52/712; 52/DIG. 1; 52/127.2; 269/904; 248/300; 248/544; 248/221.12; 248/222.41

[58] Field of Search ..... 52/712, DIG. 1, 52/749.1, 127.2; 269/904; 248/300, 544, 221.12, 222.41

[56] References Cited

U.S. PATENT DOCUMENTS

| | | | |
|---|---|---|---|
| D. 392,543 | 3/1998 | Practico . | |
| 4,089,141 | 5/1978 | Heroux . | |
| 4,254,945 | 3/1981 | Paulson et al. | 269/904 X |
| 4,314,429 | 2/1982 | Casteel et al. . | |
| 4,449,338 | 5/1984 | Reicherts . | |
| 4,460,147 | 7/1984 | Macbain | 248/222.41 X |
| 4,564,182 | 1/1986 | Svajgl | 269/904 X |
| 4,709,460 | 12/1987 | Luhowyj | 248/544 X |
| 4,709,527 | 12/1987 | Cooley . | |
| 4,782,642 | 11/1988 | Conville | 52/714 X |
| 4,868,943 | 9/1989 | Robichaund . | |
| 5,163,799 | 11/1992 | Lynn . | |
| 5,224,309 | 7/1993 | Bodell . | |
| 5,371,994 | 12/1994 | Waters . | |
| 5,407,183 | 4/1995 | Singeltary | 248/544 X |
| 5,564,236 | 10/1996 | McKinney et al. . | |
| 5,884,447 | 3/1999 | Earp | 248/544 X |
| 5,921,058 | 7/1999 | Brooker | 52/DIG. 1 X |

FOREIGN PATENT DOCUMENTS

| | | | |
|---|---|---|---|
| 655986 | 1/1938 | Germany | 248/222.41 |
| 585825 | 3/1977 | Switzerland | 52/712 |

*Primary Examiner*—Laura Callo
*Attorney, Agent, or Firm*—A. R. Eglington

[57] ABSTRACT

A combination clamp and support bracket for transient support of sheet goods during their alignment and fastening to underlying support structures, like joists and studs. The bracket has either one L-shaped longitudinal end, or at least one offset longitudinal end, or, in an alternate configuration, a pair of one L-shaped longitudinal end and the other an offset longitiudinal end. A pattern of bore holes and key slot perforations are arrayed along the bracket longitudinal axis and provide temporarily tacked pivot points and/or ledges for subjacent support of the sheet goods during placements of an abutting edge and permanent fastening. The brackets are handily displaced and ready for reuse in placement of subsequent sheet goods, like dry wall installation.

10 Claims, 5 Drawing Sheets

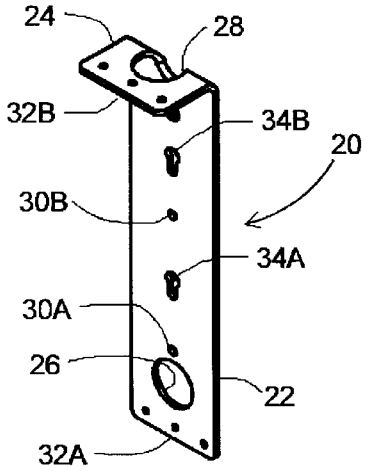
FIG. 1
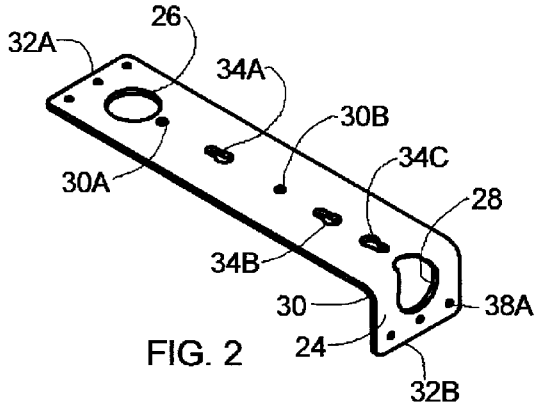
FIG. 2
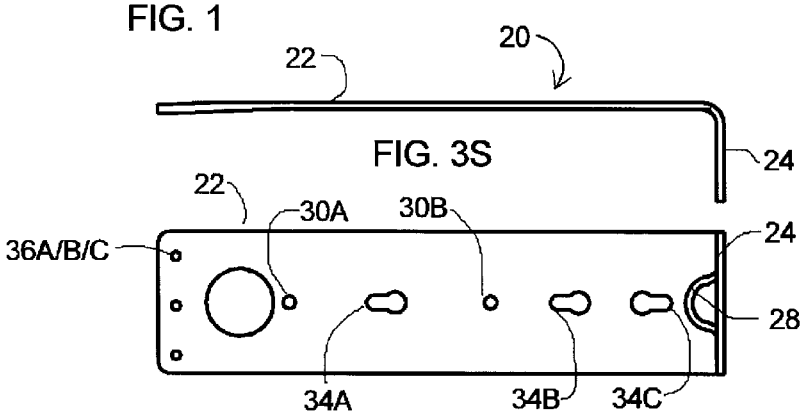
FIG. 3S
FIG. 3T
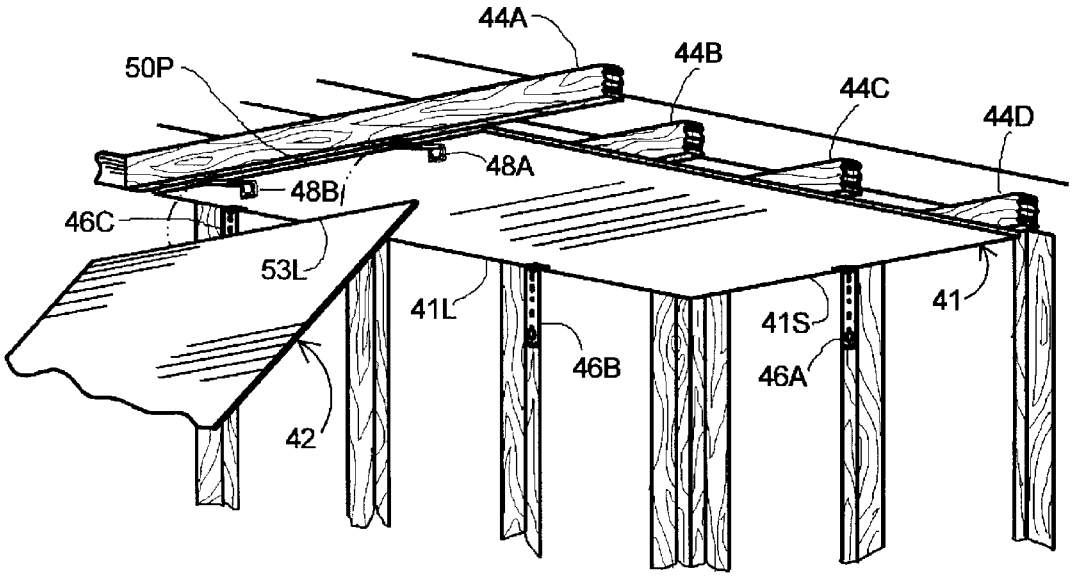
FIG. 4

DISPLACEABLE SUPPORT BRACKET FOR DRYWALL PANEL INSTALLATION

CROSS REFERENCE TO OTHER APPLICATIONS

This is a patent application submitted for filing receipt examinable, and claiming a statutory priority from copending provisional Specifications No. 60/076,767 filed Mar. 4, 1998.

BACKGROUND OF THE INVENTION

Drywall consists of a thin layer of gypsum sandwiched between two layers of heavy paper. It is commonly used in residences and buildings to cover walls and ceilings, because it is both faster and cheaper to install than plaster. Drywall panels are manufactured in standard sizes, commonly of 4×8 feet rectangular dimensions.

Due to their size and weight, these panels are both wearying and cumbersome to fasten them to either vertical framing studs or horizontal ceiling joists. It is common to use a 2×4 wooden "T" support brace, known as a "dead man," to support the sheet during installation. The use of the inventive brackets will allow the installation of 4×8 sheets horizontally overhead without the use of such a "deadman."

SUMMARY OF THE INVENTION

A drywall installation bracket adapted for displaceable usage by temporarily securing in place, along at least one peripheral linear edge of a drywall panel, so as to be suitably adjacent for being affixed to a support member (stud or joist) comprising: (a) a substantially planar, elongate rigid first segment is provided with a plurality of perforations linearly aligned coincident with the longitudinal dimension of that first member; and (b) a second bracket segment is conjoined fixedly with the first segment, along one of its transverse dimensions, being oriented at substantially right angles to the first segment, and having at least one rounded perforation preferably overlapping the seam of their conjoining with the abutting transverse dimension of the first section.

In one embodiment, the first and second segments are preferably integrally formed from a deformable, but normally rigid, metallic sheet. In another embodiment, the bracket is molded from a thermosetting resin material, one which provides sufficient inherent strength to support some of the weight of a suspended drywall panel. In all embodiments, the first segment has at least three spaced-apart, perforations therein, through which a fastening means can be inserted to temporarily align and secure the bracket to a planar rigid support member; e.g., a stud, normally used for permanent mounting of the drywall panel.

Viewed differently, the panel support bracket of the invention, is of a substantially rectangular, elongate planar member, formed of a first and second segments, with the two segments conjoined along one transverse edge, but having a substantially rectangular planar segment of markedly lesser dimensions, such that the second segment has a longitudinal length of at least 20% of the length of the elongate first segment. In a preferred embodiment, the bracket suspension perforations should be configured like a key hole slot to facilitate a sliding locking of the stud mounted bracket, and the later release thereof, after the drywall panel is permanently secured to the rigid support members by nailing.

A pair of substantially rounded perforations are provided, with one being proximal to each of the opposing longitudinal ends, the perforations serving to access the supported panel edge so as to view, adjust and fasten the panel.

In another embodiment, an elongate rigid bracket is provided with a right angle, double bend segment located intermediate the longitudinal ends, and such segment being located proximal to one of those ends. Such an embodiment is also provided with a pair of comparatively large, linearly-aligned, bore holes, each hole proximal its respective end, and a second pair of smaller, also aligned bore holes, bracketed by the first pair. One of the inner pair is also provided with a radically directed, outward linear slot, which provides a slidably engagement channel for the temporary fastener head, used while the bracket is tacked for panel support. The stepped flange feature serves well as a ledge support for one or more linear edges of a horizontally aligned panel intended to be secured to ceiling joists.

DESCRIPTION OF THE DRAWINGS

FIG. 1 is an perspective of the first embodiment of a drywall sheet installation bracket of the present invention configured in a first mode of operation;

FIG. 2 is another perspective view of the same temporary installation bracket (now seen in an inverted position) and adapted for a second mode of usage, according to the present invention;

FIG. 3T is a top plan view of the installation bracket, illustrating the arrangement and configuration of its functional, integral perforations;

FIG. 3S is a side elevational view of the bracket of FIG. 3T;

FIG. 4 is a perspective view of several of the drywall support brackets (as depicted in both of FIGS. 2/3), each in a posture of panel edge support, showing their usage in one preferred application, which involves ceiling joists (and wall studs), the brackets, serving as fixed support members for the panels;

Figure 13:
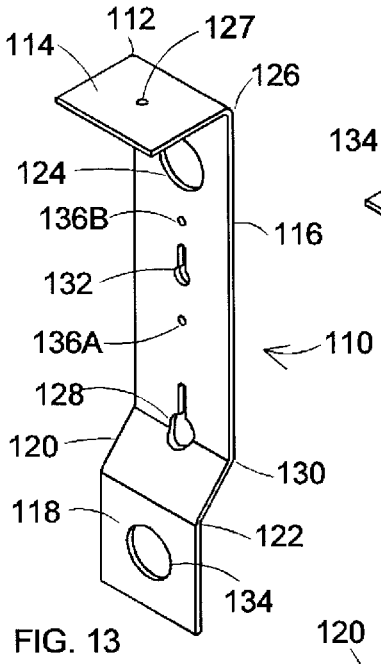
Figure 14:
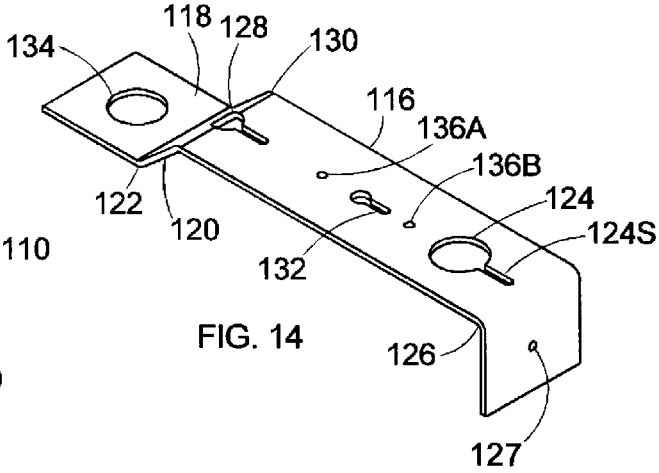
Figure 15S:
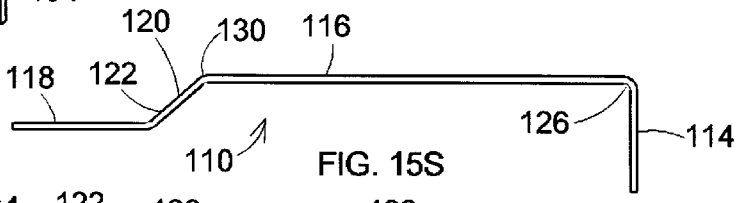
Figure 15T:
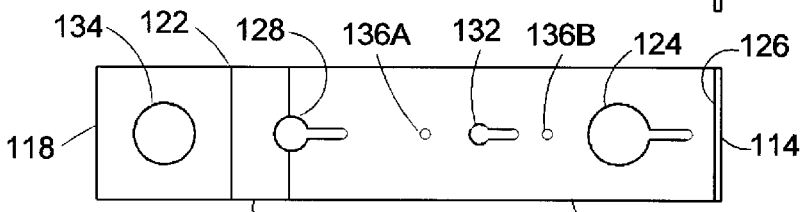
Figure 16:
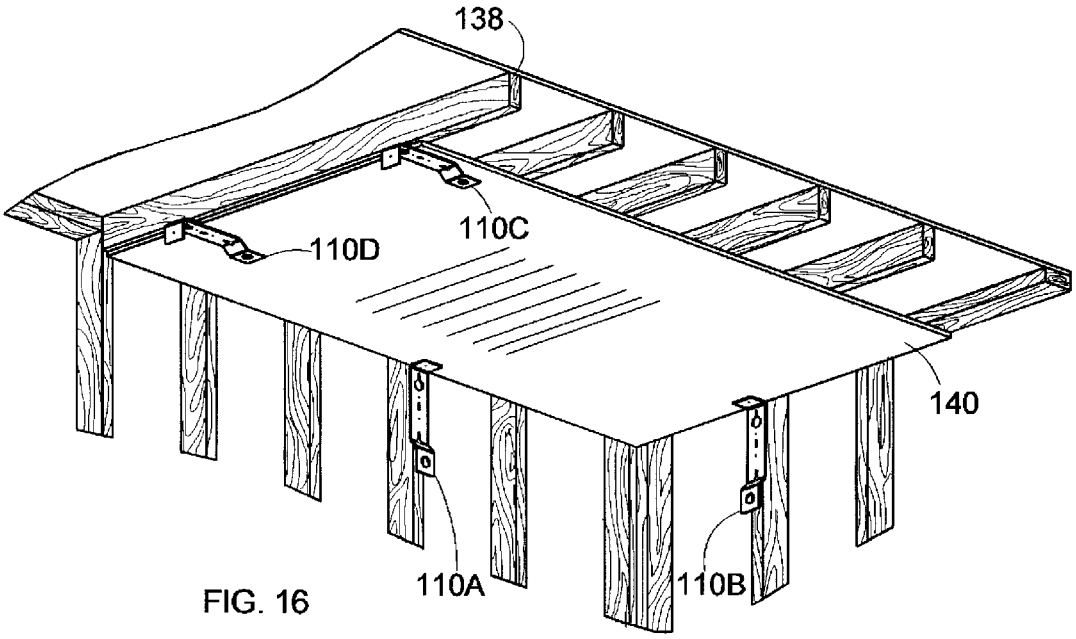
Figure 17A:
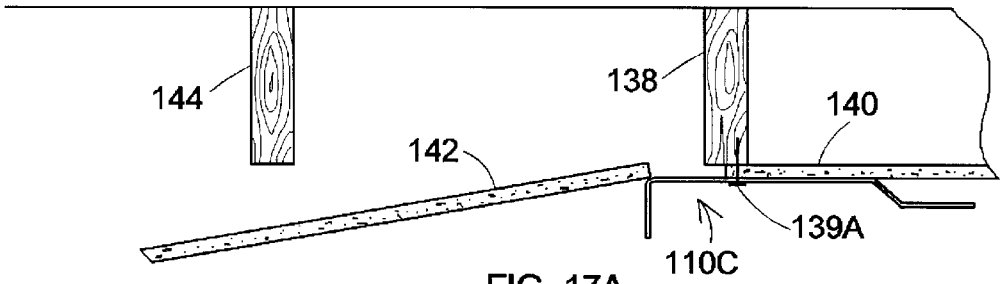
Figure 17B:
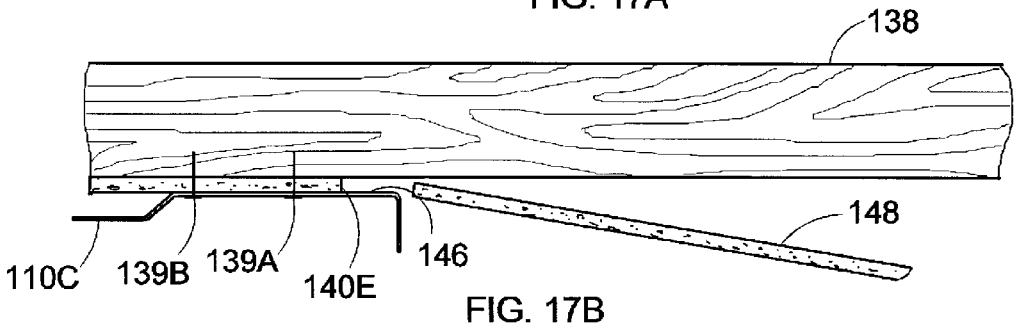
Figure 18A:
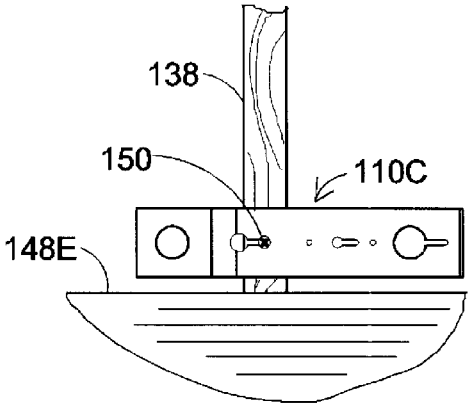
Figure 18B:
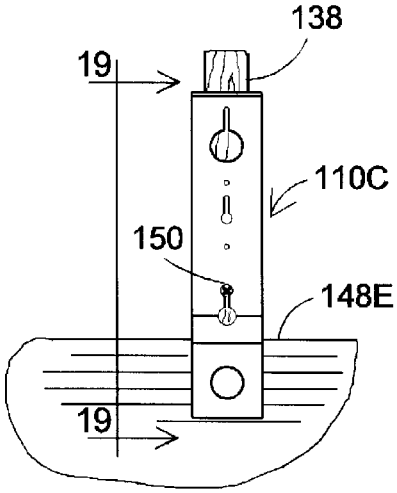
Figure 19:
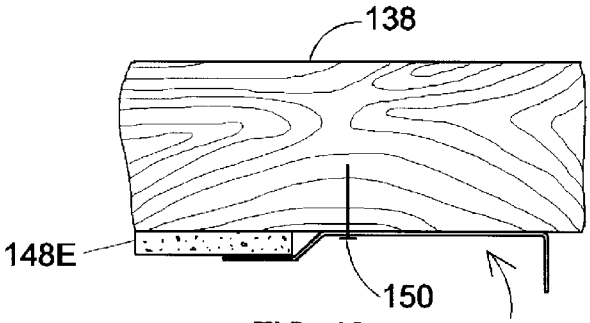

FIG. 13 is a perspective view of a third embodiment of a drywall sheet installation bracket of the present invention configured in a first mode of operation;

FIG. 14 is another perspective view of the third temporary installation bracket (now seen in an inverted position) and adapted for a third mode of usage, according to the present invention;

FIG. 15S is a side elevational view of the installation bracket of FIG. 14;

FIG. 15T is a top plan view of the installation bracket of FIG. 14, also illustrating the arrangement and configuration of its functional, integral perforations;

FIG. 16 is a perspective view of several of the drywall support brackets (as depicted in both of FIGS. 13/14), each in a posture of panel edge support, showing their usage in two preferred applications, which involves ceiling joists (and wall studs), with the brackets, serving as transient support members for the panels until tacking;

FIG. 17A is a side elevational view of one of the joist-tacked support brackets of FIG. 14 showing a subsequent stage (engagement) of its usage in the depicted application of FIG. 16;

FIG. 17B is an end elevational view of the open longer edge of the ceiling sheet, as seen being installed in FIG. 17A, now being joined by another ceiling sheet;

FIG. 18A depicts (looking upward) an in-place bracket of FIGS. 13/14, temporarily secured to one spaced apart, ceiling joist, and pre-positioned to receive and retain one linear edge of a sheetrock, or wafer board, panel;

FIG. 18B depicts (still looking upward) the bracket of 18A, now rotated 90° to provide a lateral edge ledge for a sheetrock/wafer panel, while such a positioned planar panel is being fastened permanently to the ceiling joists; and, FIG. 19 depicts an end elevational view of the bracket of FIGS. 18A/B, depicting the edge support for a sheetrock panel provided by the offset flange segment of the bracket.

DETAILED DESCRIPTION OF A PREFERRED EMBODIMENT

Referring to FIG. 1, the present invention in a first embodiment is of a drywall sheet/panel support device 20, adapted to facilitate the temporary support of a drywall panel (not seen) during the permanent installation of plural panels in the course of drywall home building. Support bracket 20 is a substantially planar, rigid, formed structure comprised of an elongate planar element 22 (seen vertically aligned) and a right-angled, shorter element (tongue), 24 (horizontally aligned). Tongue 24 is usually formed as an integral part of the bracket, and is achieved by metal working while in the semi-soft stage. It is also possible to prepare the bracket from thermosetting plastics suited to building construction.

Device 20 is provided with a plurality of perforations of differing configuration, aligned linearly, and preferably coincident with its longitudinal midline. A first pair of comparatively large, conveniently circular, bore holes, 26/28, each being proximal to its respective longitudinal end. One bore, bore 28, is centered on the seam 30 of the elbowed end seam of device 20, while the other hole 26 is located in the planar segment 22. Two smaller perforations, 30A/B, are located intermediate of the device edges, 32A/B, and serve as temporary fastener access ports to the underlying panels. Also, they provide two or more key-slotted, perforations, 34A,B, and C; as depicted, with two of them, 34A and B, are aligned toward the planar segment end 32A and the third key slot, 34C, is aligned towards the flanged end 32B.

FIGS. 3T and 3S depict the bracket 20 in a top plan view, and a side elevation view, respectively. Note how large bore hole 28 overlaps the angled end 24 of the device. At each end, a set of small, transversely aligned perforations, 36A/B/C, and 38A/B/C, respectively, are provided which serve as temporary fastener access ports.

FIGS. 4/5 shows several of the present panel installation devices, L-bracket 20, located and mounted for their intended functions; i.e., for installing drywall sheets, (or plywood panels), like 41/42, on already in-place, ceiling joists, 44A/B/C/D. The bracket is facile to use effectively. One vertical mode for such brackets is 46A, which serves to retain the shorter, linear edge, 41S, of already installed ceiling sheet 41 in place, while another bracket pair, 46B/C, serve to be temporarily mounted on the adjacent longer linear edge, 41L. Opposing (proximal) leading edge 50P of panel 41 has a another bracket pair, 48A/B, temporarily mounted, horizontally, being tacked pivotally along the panel proximal edge 50P. Each bracket, like 48B, presents an outwardly extending lip, generically 52, (FIG. 5), which lip protrudes somewhat beyond the vertical side wall of ceiling joist 44A. Ceiling-pinned brackets, 48A and 48B, will then provide an effective subjacent support means for still unfastened panel 42, as it is being raised, and has its leading edge 53L slip over bracket lips 52B (and 52A). The near final position result is as depicted in FIG. 5A.

When the trailing edge 53T of panel 42 closes on joists 44A, 44E, and 44F, the installer (not shown) can begin securing the drywall sheet at the opposing edge 52T, working towards the temporarily supported sheet edge 42. After the entire sheet 42 is fastened to the ceiling, the plural brackets 46A/B and 48A/B, can be removed with a hammer claw (not shown), and then they are ready to be re-used to install the next sheet (not shown), working in either direction.

Figure 5A:
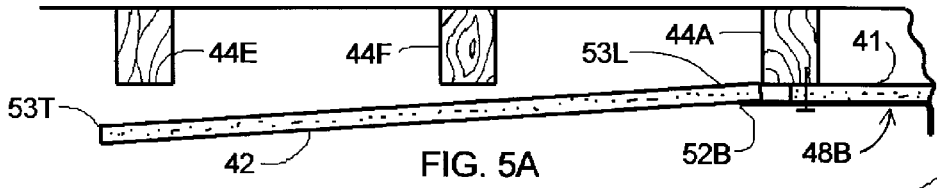
FIG. 5A is a side elevational view of one of the tacked support brackets showing a subsequent stage (engagement) of its usage in the depicted application of FIG. 4.
Figure 5B:
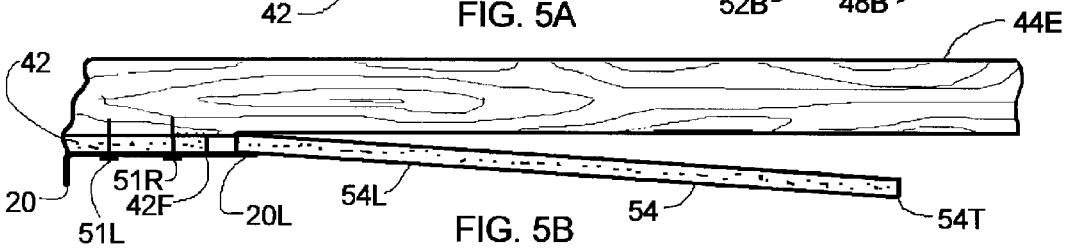
FIG. 5B is an end elevational view of the open shorter edge of the ceiling sheet seen installed in FIG. 5A, now being joined by another ceiling sheet.

FIG. 5B depicts the now ceiling- fastened sheet 42 of FIG. 5A from a left hand, end view. Depicted joist 44E is the endmost one, to which the fastened sheet edge 42F is already permanently tacked. An L-bracket 20 is temporarily double fastened overhead into the installed sheet 42, with the long leg of bracket 20 being positioned so that its last two inches plus extend beyond the facing edge 42F of the already installed sheet 42, thus providing a horizontal support ledge 20L. New sheet 54 is slipped over bracket ledge 20L (just as depicted in the perspective view for the upward oriented edge 53L of panel 42 of FIG. 4). Sheet 54 is temporarily supported on the bracket ledge 20L, while its opposing free end, 54T, is swung upwardly to make edge contact with joist 44E, inter alia. Conventional fastening nails (not shown) will anchor the then horizontal sheet edge 54T to the overhead leftmost joist 44A, to be followed, as well, by fastening same to the other parallel joists (44B/C/D, of FIG. 5A). The bracket-supported end 54L of sheet 54 is then likewise fastened, then bracket 20 itself, is shifted slightly and released, with its support nails (51L/R) being pounded flush with the underlying studs, or joists, like 42E. This view depicts the manner of installation of new sheet rock 54 along the longitudinal forward edge of installed panel 41, first depicted in FIG. 4.

Figure 6:
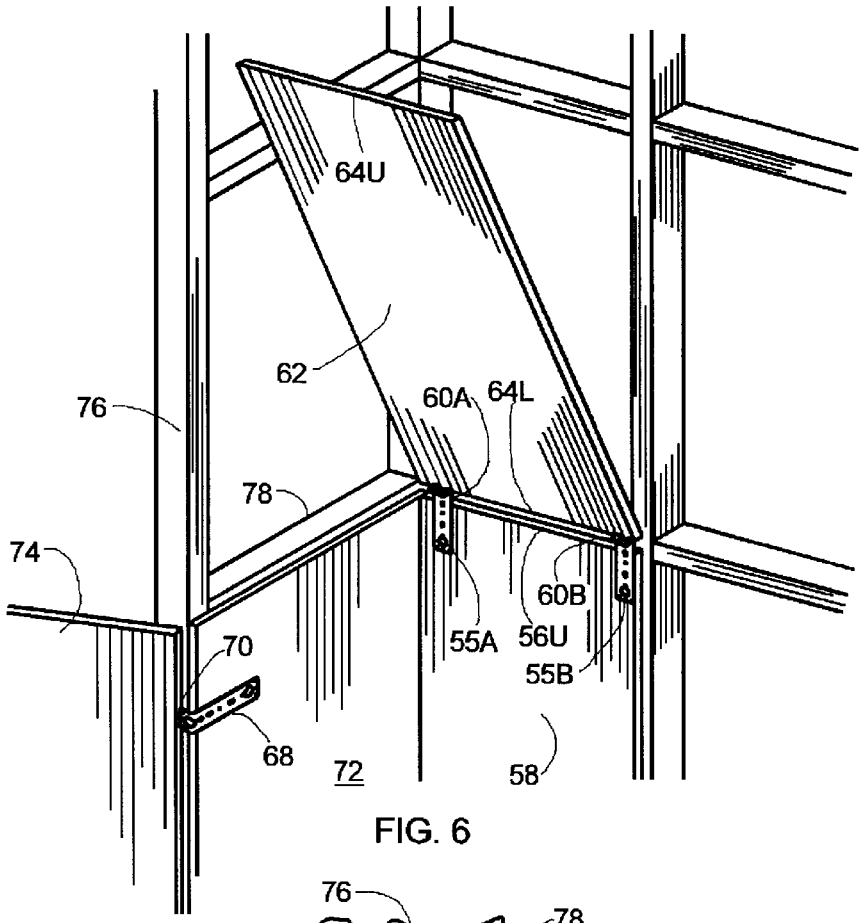
FIG. 6 is a perspective view of a pair of the support brackets, and a spaced-apart, single bracket, each of them seen in another preferred application of the embodiment depicted in FIG. 1, involving the use of wall joists serving as the fixed support members for the brackets, while the drywall panels are being installed.

FIG. 6/7 illustrates an alternate application of bracket device 20A (FIG. 1). Two brackets 55A/B, are aligned vertically, and spaced apart, being temporarily tacked at their lower end, to the upper edge 56U of an in place board 58. The bracket shorter ends 60A/B are oriented outwardly, with their exposed margin (not seen) being adjacent the bracket seams 30 (FIG. 2), and they are placed slightly above the horizontal edge 56U of the in place lower board 58.

When used in this mode, paired devices, 20, will provide a support for the vertical insertion of inclined panel 62. When panel 62 has been fastened vertically, the paired brackets (54A/B) can be removed handily with a hammer claw. If a ceiling is somewhat over eight feet tall, one would encounter substantial waste by having to cut a twelve foot sheet down to the requisite eight foot plus dimension. As another example, if the ceiling is of a cathedral configuration, the sheets/panels, like 62, will also require a temporary, dual-edge bracket support (64U/64L). Using two opposing side, pairs of brackets, like 54A/54B, will be useful in either case of non-standard size panels, or of non-purely vertical installations.

Also depicted in FIG. 6, is another bracket 68, horizontally aligned, with its short leg 70, turned around the longer edge of installed support panel 72. Another spaced-apart, underlying bracket (not shown), would provide lateral (vertically) support for the snug aligning of right angled, panel 74, to be followed by its permanent tacking to the stud 76.

Figure 7:
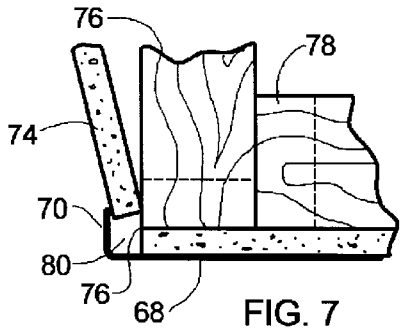
FIG. 7 is a fragmentary top view of the isolated horizontal bracket of FIG. 6 receiving at right angle, the planar panel while both are supported by a common vertical stud.

The fragmentary of FIG. 7 is a top sectional view of one elongate, linear corner 76, as defined by conjoined upright studs/joists, 76 and 78. It depicts how a readily approaching panel 74 slips in the recess 80 defined by horizontal bracket 68. When the new panel 74 is permanently fastened, bracket 68 is handily separated, and is promptly reusable, as earlier described.

Figure 8:
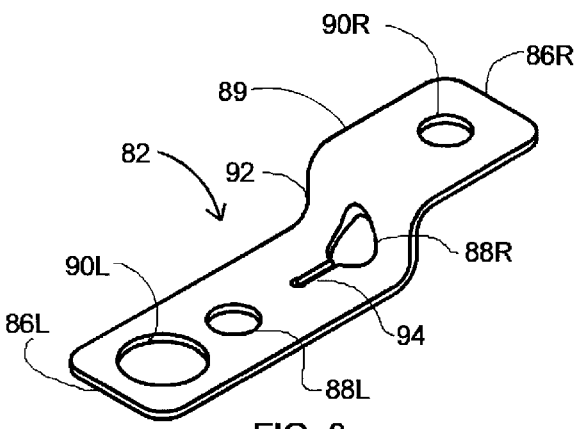
FIG. 8 is another perspective view of another embodiment for the installation bracket, which is particularly useful in locating and holding adjacent drywall panel edges uniformly, while the panels are being pinned to the ceiling joists of a structure.
Figure 9:
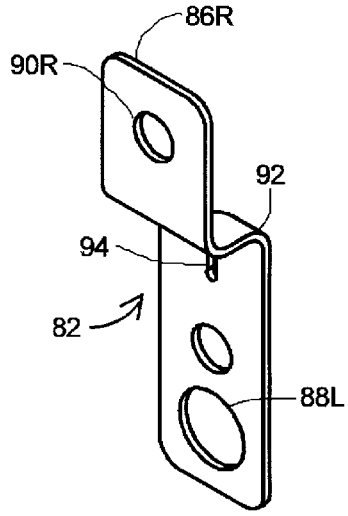
FIG. 9 is another perspective view of the bracket of FIG. 8 depicting same in an alternate juxtaposition for usage.
Figure 10:
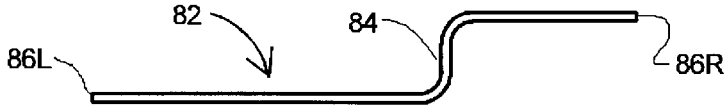
FIG. 10 is a side elevational view of the bracket of FIGS. 8/9, depicting the stepped flange proximal to one longitudinal end thereof.

The views of FIGS. 8, 9, and 10 depict an alternate embodiment of the support device of the present invention, generally bracket 82. FIG. 8 is a perspective view of the isolated bracket 82, while FIG. 9 is an alternate position for the bracket. The side elevation view of FIG. 10 depicts the stepped (flanged) configuration 84 in profile. Bracket 82 is provided with a double bend, right angle flange segment 84, located intermediate of its longitudinal ends 86L/R. This embodiment is also provided with a pair of enlarged, linear aligned bore holes, 88L and 88R, which are bracketed by another set of bore holes, 90L and 90R, with the latter set being proximal to the respective bracket ends, 86L/R. One of the inner set of bore holes, 88R, is centered upon the inner transverse seam 92 of the flanged portion 86R of bracket 92. The seam-centered bore hole 88R is also provided with an integral, radially directed, outwardly oriented linear slot 94. Slot 94 provides for slidable engagement of a temporary fastener, or the like (not shown), that pins the bracket 82, pivotably, to an underlying joist or stud (not seen).

Figure 11A:
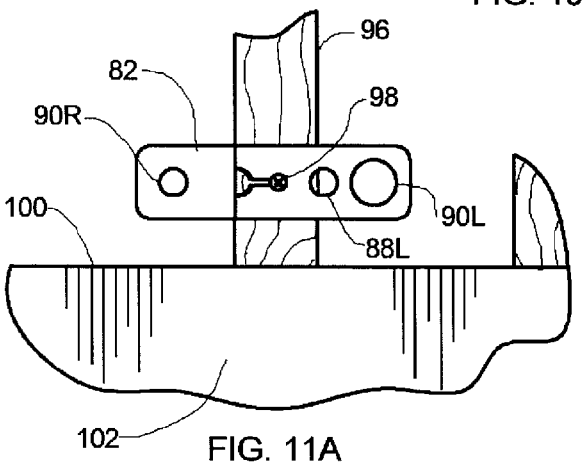
FIG. 11A is the in place bracket (looking upward) of FIGS. 8–10, temporarily secured to a spaced apart, ceiling joist, and pre-positioned to receive and retain one linear edge of sheetrock, or wafer board, panels.
Figure 11B:
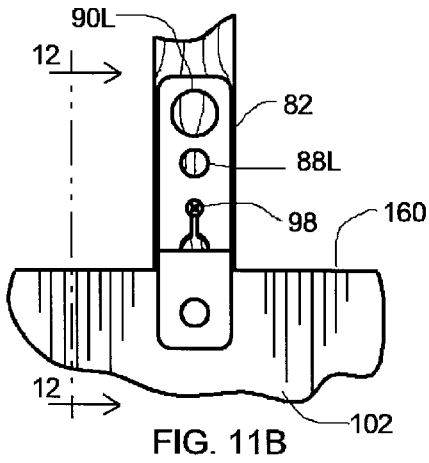
FIG. 11B depicts (looking upward) the bracket of 11A rotated 90° to provide a lateral edge ledge for the sheetrock/ wafer panel, while the positioned planar panel is being fastened permanently to the ceiling joists; and, FIG. 12 depicts an end elevational view of the bracket of FIGS. 11A/B, depicting the edge support for a sheetrock panel provided by the offset flange segment of the bracket.
Figure 12:
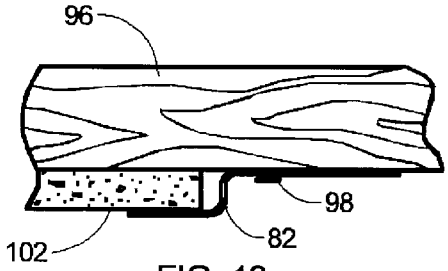

An initial position of flanged bracket 82 is depicted in FIG. 11A, looking upwardly towards a ceiling joist 96, upon which it is pinned pivotably, by fastener head 98. The need for its close proximity to the lateral edge 100 of a positioned board 102 is depicted. Upon a 90° rotation of bracket 82 to the position of FIG. 11B, the underlying support provided for board 102 becomes evident. Like brackets and adjacent ceiling joists (not shown) would provide further subjacent support to the aligned board 102 while joist contacting. While board 102 is positioned as depicted in FIG. 12, when the supported board 102 has been fully fastened in such installation position, then the bracket 82 is rotated back into the position of FIG. 11A, slid sideways leftward, and released from the support joist 96. The bracket is now ready for reuse. Then fastener 98 is simply nailed down flush with the joist 96.

Referring now to FIG. 13, there is depicted a third embodiment integrating the features and advantages of the first and second embodiments of the present invention, namely tool 110. This tool is further adapted to facilitate support of a drywall panel, such as depicted in FIG. 16, during permanent installation of plural drywall panels during dwelling construction. Composite features bracket 110 is a substantially rigid, multiplanar structure comprised of four discrete, but integrated, segments. Bracket 110 comprises a generally L-shaped member having at least one longitudinal end 112, two planar segments 114 and 116 conjoined at substantially right angles to one another. First end segment 114is the shorter one, and intermediate segment 116 is the substantially longer one. A third and fourth conjoined planar segments 118 and 120 are located at the other longitudinal end 122 of tool 110. Parallel segment 118 is laterally offset from the elongate segment 116 by an intermediate segment 120, which is integral with both the elongate segment 116 and the parallel segment 118. Inclined segment 120 is oriented at essentially obtuse angle to each of conjoined segments 116 and 118.

A first larger key slot perforation 124 is located proximal to the transverse seam 126 of L-shaped segments 114 and 116, with the slot-like portion 124S thereof preferably pointing towards the closer seam 126. A second, somewhat smaller key slot perforation 128, is located overlapping the transverse seam 130 between the third and fourth planar segments 118/120. A third, even smaller key hole perforation 132 is located substantially centrally of the second segment 116, and has its slot portion pointing towards seam 126 of the first and second segments. A first rounded bore hole 134 is located centrally of the third segment 118. Finally, a pair of bore holes 136A and 136B, substantially smaller than first bore hole 134 in segment 118 are located straddling smaller third key slot perforation 132. However, the tool is operational if smaller bore hole 136A is omitted. Still, centrally-positioned small bore hole 137 is useful.

The depiction of FIG. 14 is an obverse view of the tool of FIG. 13 revealing more detail; likewise, for the side elevation and top elevational views of FIG. 15, which lend some clarity to the profile and siting of the several perforations.

FIG. 16 depicts a new ceiling-pinned first drywall sheet 140, held peripherally in final position until joist-tacking, by the brackets of the two FIGS. 13/14. Two of the tools, 110A/B, are in the opposing vertical positions of FIG. 13 and one other of the tools, 110C, is in the horizontal support position of FIG. 14. Another wallboard will be placed adjacent to leading edge 140E of fastened board 140 just as now depicted in FIG. 17A.

In FIG. 17A, there is depicted a shorter edge view of the pinned board 140 of FIG. 16, already tacked to joist 138, now with tools 110C/D (suspended from joist 138) oriented to receive the approaching second board 142, the free edge of which board will be pivoted upwardly to be tacked to the adjacent joist 144; whereupon horizontal tool 110 can either be removed, or rotated 90° on its axis to the position depicted in FIG. 17B. In this view, the rotated tool 110C, still double tacked to first joist 138 (fasteners 133A/B), presents a projecting ledge 146, on which a third inclined board 148 can be edge-seated, then the board is moved inwardly and upwardly to be fastened, along one lateral edge 140E presented by the in situ board 141 to overhead joist 138, inter alia.

The initial position of double flanged ends bracket 110C, is depicted in FIG. 18A, looking upwardly towards the ceiling joist 138, upon which it is pinned pivotally and displaceably by a fastener head 150. The need for tool close proximity to the board lateral edge 148E is depicted.

Upon the 90° rotation of bracket 110C to overlap the horizontal board 148 in the position of FIG. 18B, the subjacent support provided for board 148 becomes evident. The adjacent joists (not shown) provide added subadjacent support. Once board 148E is positioned as in FIG. 19, and after the supportive board has been fully fastened in its installation position, then bracket 110c is rotated back to the position of FIG. 18A, the tool is shifted sideways/rightward to be released from the tacked support of joist 138. The bracket 110D, or 110A/B/C of FIG. 16 are ready for multiple reuses. Then protruding fasteners, like 139 of FIG. 17B, and 150 of FIG. 19 are simply nailed down flush with the adjacent joist 138.

The presently described installation bracket would have other field applications as well. For example, it could be used as a temporary support for one end of a horizontal 2"×4"×16' (or larger) ledger. Still another application would be to support in place one end of a 2"×6"×16' face board, for the purpose of nailing the face board to the tail cuts of the rafters.

In all the above examples, the inventive brackets should save contractors both time and expense, either by requiring less manpower or less individual effort, or both. Manufacturing the bracket from mild steel (or aluminum) flat bars using conventional fabrication techniques, like metal stamping and bending, should result in a relatively inexpensive but durable quality product, which could see countless cycles of usage, knockdown and reuse.

IN OPERATION

To start the installation of a drywall ceiling (in one corner), a worker would nail the inventive bracket of the first embodiment to the second and fifth studs on the panel long edge, and the second stud on the panel short edge, and hanging bracket 82 attached to ceiling joist. The short leg of each right angle bracket would protrude outward and would be positioned on the stud with just enough clearance of the panel to slide between the top of the bracket and the underside of the ceiling joist.

One or two workers could then slide this first panel into place. At this point, one panel long edge at the wall and the other panel long edge, and one short edge of the panel, all would be concurrently supported. The remainder of the installation would be standard. Drywall nails or screws would be installed as usual, at normal intervals, along the joists. After this, a slight tap with a hammer on the short leg of the formerly supporting brackets would release the brackets from the panel. The fastener nails which held the brackets would then be driven the rest of the way into the drywall.

On the exposed outer edge of the first panel, brackets, like 20 (FIGS. 1/21), are installed and are used to help install a second sheet. The slightly tapered edge on the brackets, if faced outward toward the area where the second panel was to be installed, would form an easy supporting structure over which a second panel edge could be slipped. The entire process would be repeated until the ceiling was complete.

For installation of a drywall panel on the upper half of a vertical wall, one or more brackets would be installed in the same manner along the supporting studs. The drywall panel would then be lifted into place. The worker would only need to hold the panel against the wall studs since most of the weight of the panel would be supported by the underlying brackets. The once erected panel would then be nailed in place, and the brackets readily separated from the studs by lateral shift of the temporary fastener heads.

In operation, the combination tool depicted in FIGS. 13–15, can be described as being more user friendly. It manages to integrate the operating features of the embodiment of FIGS. 1/2 and the embodiment of FIGS. 8/9 into one unit. While initially more costly to fabricate, rather than using two tools, the one combination tool reduces production costs compared to that of the two tools, and simplifies packaging and handling. It also expands the range of useful tasks at the building site.

What is claimed is:

1. A combination clamp and support bracket adapted for the temporary support of planar panels during their building installation, the combination comprising:

(a) a generally L-shaped member having two planar segments conjoined at a substantially right angle to one another;

(b) a first segment comprising the shorter one end and the second segment comprising the substantially longer other end;

(c) a pair of generally rounded bore holes with one bore hole being proximal to the shorter end and also overlapping and being centered on the seam of the conjoined segments, and the other bore hole being situated proximal to the outer transverse edge of the second segment;

(d) a pair of keyhole-type slots, spaced apart and similarly aligned, and located wholly between the longitudinal ends of the longer planar segment; and, (e) at least two perforations located in the longer segment, spaced apart, disposed intermediate of the two bore holes and arrayed on an imaginary line drawn between and bisecting the said two bore holes; and, (f) a third key slot located proximal to the transverse seam of the two segments.

2. The bracket of claim 1 wherein the pair of slots have their slot portions oriented towards the outer transverse edge of the second segment.

3. The bracket of claim 1 wherein the third key slot has its slot-like portions oriented away from the outer transverse edge of the second segment.

4. A combination tool for positioning and supporting wallboard during its building installing, comprising:

(a) a generally elongate, rectangular member comprised of three contiguous planar segments;

(i) a longer first segment having at least two bore holes, presenting a first contact surface;

(ii) a laterally offset shorter, second segment having at least one bore hole proximal to the transverse free edge of that second segment, presenting a second contact surface;

(iii) an intermediate third segment having its transverse edges integral with the inner transverse edges of the first and second segments defining a first and second seams and oriented at substantially right angles to both of them and so effecting a lateral offset between the first and second segments; and (b) a single key slot perforation located intermediate of the longitudinal ends of the member and having the rounded portion thereof located overlapping and being centered on the seam of the conjoined first and third segment; and (c) a third bore hole located proximal to the free transverse edge of the second segment.

5. The bracket of claim 4 wherein the single key slot has its slot-like portion thereof located in the first longer segment.

6. The bracket of claim 4 wherein the one of the two bore holes in the first segment is proximal to the outer transverse edge and has a larger diameter than the other bore hole in the first segment.

7. A combination tool for positioning and supporting wallboard during its building installing, comprising:

(a) a generally L-shaped member having a first two planar segments forming a first longitudinal end conjoined at a substantially right angle to one another defining a first seam with the first segment comprising the shorter one and the second segment comprising the substantially longer other one;

(b) a third and fourth planar segments comprising the other longitudinal end of the bracket comprising;

(i) a laterally offset third segment having a first bore hole proximal to that other longitudinal end; and, (ii) an intermediate fourth segment integral with the transverse inner edges of the second and third segments and being oriented essentially at an obtuse angle to each, with the second and fourth segments defining a second seam;

(c) a first key slot perforation located proximal to the first seam of the first and second segments;

(d) a second key slot perforation located overlapping the second seam between the second and fourth segments;

(e) a third key slot perforation and located substantially centrally of the second segment; and (f) a second bore hole located between the first and third key slot perforations.

8. The combination tool of claim 7 wherein the laterally offset third segment is substantially shorter than the second segment.

9. The combination tool of claim 7 wherein the second key slot perforation is appreciably smaller than the first key slot perforation.

10. The combination tool of claim 7 wherein a third bore hole is located substantially centrally of the shorter first planar segment of the tool.

* * * * *